US008517369B2

(12) United States Patent
Tsujita

(10) Patent No.: US 8,517,369 B2
(45) Date of Patent: Aug. 27, 2013

(54) PRINTING APPARATUS, CONTROL METHOD FOR THE SAME, AND STORAGE MEDIUM

(75) Inventor: Kosuke Tsujita, Tama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/599,629

(22) Filed: Aug. 30, 2012

(65) Prior Publication Data

US 2013/0056922 A1 Mar. 7, 2013

(30) Foreign Application Priority Data

Sep. 6, 2011 (JP) ..... 2011-193722

(51) Int. Cl.
*B65H 3/44* (2006.01)

(52) U.S. Cl.
USPC .... 271/9.02; 271/9.03; 271/9.05; 271/258.04

(58) Field of Classification Search
USPC ..... 271/9.02, 9.03, 9.05, 258.04; 399/16, 399/23
See application file for complete search history.

(56) References Cited

U.S. PATENT DOCUMENTS

| | | | | |
|---|---|---|---|---|
| 8,002,259 | B2 * | 8/2011 | Kishimoto et al. | 271/9.01 |
| 8,286,961 | B2 * | 10/2012 | Kanamoto | 271/9.02 |
| 2008/0258374 | A1 * | 10/2008 | Inoue | 271/9.03 |
| 2009/0160117 | A1 * | 6/2009 | Negishi | 271/3.14 |
| 2009/0166949 | A1 * | 7/2009 | Unno | 271/9.03 |
| 2009/0189330 | A1 * | 7/2009 | Saito et al. | 271/9.05 |
| 2011/0164887 | A1 * | 7/2011 | Takenaka | 399/16 |
| 2011/0170882 | A1 * | 7/2011 | Matsumoto | 399/16 |

FOREIGN PATENT DOCUMENTS

JP 2007-076868 A 3/2007

* cited by examiner

*Primary Examiner* — David H Bollinger

(74) *Attorney, Agent, or Firm* — Canon U.S.A., Inc., IP Division

(57) ABSTRACT

To suppress a drop in printing productivity due to opening of a sheet storage unit in a group by a user instruction while printing is performed by switching two or more sheet storage units registered as the group.

7 Claims, 13 Drawing Sheets

PRINTING APPARATUS, CONTROL METHOD FOR THE SAME, AND STORAGE MEDIUM

BACKGROUND OF THE INVENTION

1. Field of the Invention

The present invention relates to a printing apparatus, a control method for controlling the printing apparatus, and a storage medium.

2. Description of the Related Art

Some printing apparatuses are configured to convey a sheet from any one of a plurality of sheet storage units and print an image on the conveyed sheet. Japanese Patent Application Laid-Open No. 2007-76868 discusses a technique for grouping a plurality of sheet storage units as a single sheet storage unit. Sheet storage units containing sheets of the same type and the same size are grouped together, and an automatic cassette change (ACC) control is performed within the grouped sheet storage units. Such a technique virtually enables printing using a large-capacity sheet storage unit.

The foregoing conventional technique has the following problem. Suppose, for example, that a user uses a print on demand (POD) machine to group sheet storage units on a paper feed deck and performs printing using the grouped sheet storage units. If another user with the intention of performing different printing presses an open button on a sheet storage unit that is currently feeding sheets, an electronic lock on the sheet storage unit will neither be released nor be opened.

If another user presses an open button on another sheet storage unit in the group, however, the sheet storage unit will be electronically unlocked and opened. If the sheet storage unit currently feeding sheets runs out of paper when another sheet storage unit in the group to which the sheet storage unit currently feeding sheets belongs is open, the sheet feeding source is not able to be switched to the sheet storage unit that is open. If there is no other sheet storage cassette that is capable of feeding sheets, the existing print job stops printing due to paper-out.

SUMMARY OF THE INVENTION

According to an aspect of the present invention, a printing apparatus for conveying a sheet from any one of a plurality of sheet storage units configured to store sheets and printing an image on the conveyed sheet includes a registering unit configured to register two or more of the plurality of sheet storage units as a group, a printing unit configured to continue printing by switching a sheet conveyance source to another of the two or more sheet storage units registered as the group in a case where an amount of sheets set in one of the two or more sheet storage units registered as the group by the registering unit becomes a predetermined amount or lower when printing using the sheet storage unit is in progress, a receiving unit configured to receive an instruction to open any one of the plurality of sheet storage units, and a control unit configured to permit opening the instructed sheet storage unit by the instruction in a case where the receiving unit receives the instruction during execution of printing and the instructed sheet storage unit does not belong to the same group as that of the sheet storage unit used in the printing, and restrict opening the instructed sheet storage unit by the instruction in a case where the receiving unit receives the instruction during execution of printing and the instructed sheet storage unit belongs to the same group as that of the sheet storage unit being used in the printing.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

<Configuration of Image Forming Apparatus>

Figure 1:
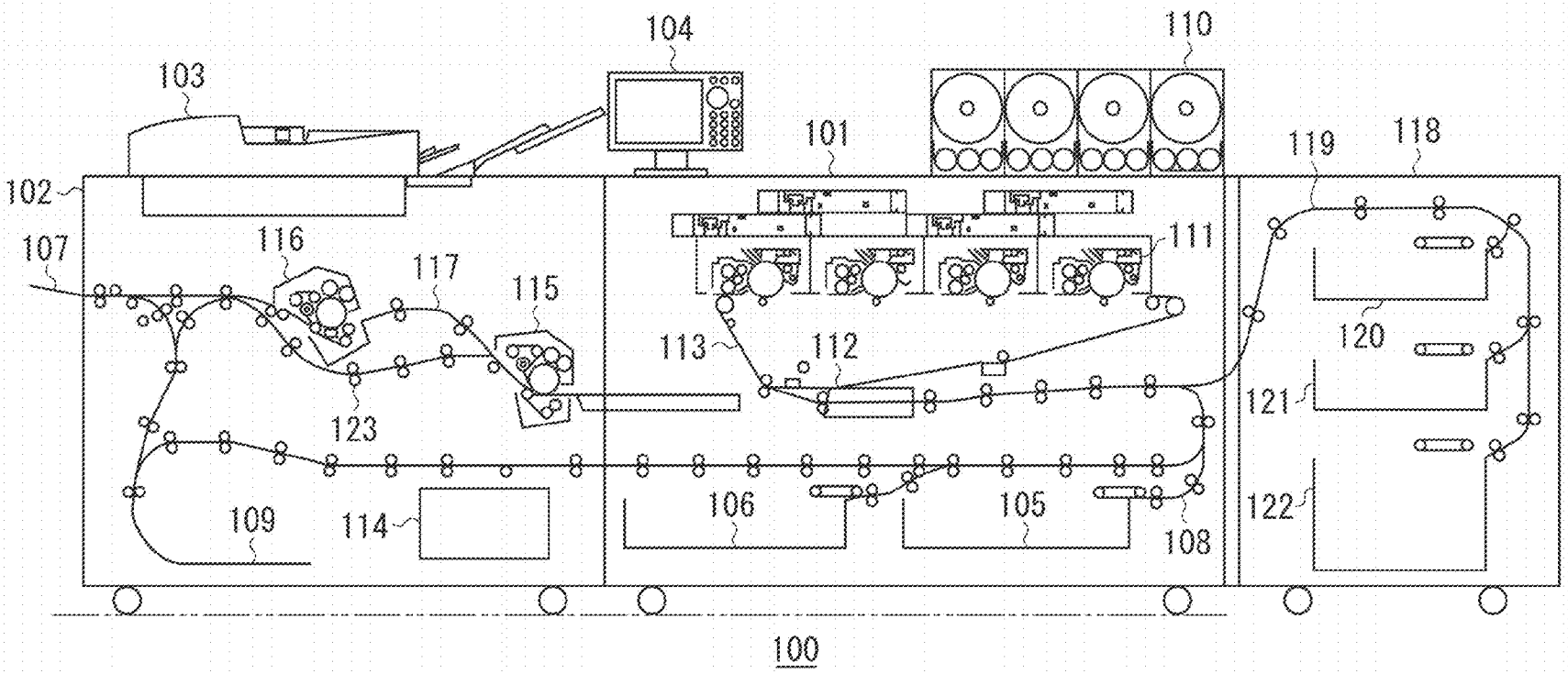
FIG. 1 is a sectional view illustrating a configuration example of a printing apparatus according to an exemplary embodiment of the present invention.

FIG. 1 is a sectional view illustrating a configuration example of a printing apparatus according to an exemplary embodiment of the present invention. As an example, a printing apparatus 100 to which a scanner unit, a sheet feeding unit, and a sheet discharging unit can be connected will be described. The printing apparatus according to the present exemplary embodiment is applicable to an image forming apparatus that includes a fixing unit, such as a copying machine and a multifunction peripheral.

The sheet feeding unit described in the present exemplary embodiment includes a plurality of sheet storage cassettes (sheet storage portions) that can be grouped. Each sheet storage cassette includes a button for opening the sheet storage cassette to replenish the sheet storage cassette with sheets (paper).

The printing apparatus 100 described in the present exemplary embodiment groups a plurality of sheet storage portions that are selected by the user from the plurality of sheet storage portions, and performs sheet feeding processing. The processing by which the user selects sheet storage portions to perform grouping from the plurality of sheet storage portions will be described below with reference to FIG. 3.

In FIG. 1, the printing apparatus 100 includes an image forming unit 101, a fixing unit 102, a scanner unit 103, an operation unit 104, a sheet discharging unit 107, a toner replenishing unit 110, and an external sheet feeding apparatus 118. The image forming unit 101 includes sheet storage units 105 and 106, a conveyance unit 108, primary transfer units 111, a transfer belt 112, and a secondary transfer unit 113. The fixing unit 102 includes a switchback unit 109, a waste toner storage unit 114, fixing units 115 and 116, and conveyance units 117 and 123. The external sheet feeding apparatus 118 includes a conveyance unit 119 and sheet storage units 120, 121, and 122.

The scanner unit 103 scans a document to generate electronic data of an image. The operation unit 104 accepts operator's various instructions to the printing apparatus 100. The operation unit 104 includes hard keys and a touch-panel display unit.

The sheet storage units 105, 106, 120, 121, and 122 are loaded with sheets (recording material) to be printed by the printing apparatus 100. The sheet storage units 105, 106, 120, 121, and 122 each include an open button for sheet replenishment. When sheets are being fed from any one of the sheet storage units 105, 106, 120, 121, and 122, the sheet storage unit 105, 106, 120, 121, or 122 is electronically locked so that the sheet storage unit 105, 106, 120, 121, or 122 will not be opened even if the open button of the sheet storage unit 105, 106, 120, 121, or 122 is pressed.

The sheet discharging unit 107 discharges a printed sheet to outside the printing apparatus 100. The conveyance units 108, 117, 119, and 123 each include sheet-conveying rollers at regular intervals. The switchback unit 109 reverses the output side of a sheet when discharging the sheet to the sheet discharging unit 107. The toner replenishing unit 110 replenishes the image forming unit 101 with developers, or toners.

The primary transfer units 111 transfer toner images formed according to image data to the transfer belt 112. The secondary transfer unit 113 transfers the toner images having transferred to the transfer belt 112, to a sheet. The waste toner storage unit 114 stores excessive toners generated in the course of the transfer processing. The fixing unit 115 applies heat and pressure to the sheet to which an image is transferred by the second transfer unit 113, whereby the toners are fixed to the sheet.

The fixing unit 116 further applies heat and pressure to the sheet to which the image is fixed by the fixing unit 115, thereby enhancing the fixing of the image. The conveyance units 108, 117, 119, and 123 are conveyance paths for conveying a sheet.

The conveyance unit 117 is a conveyance path for conveying a sheet from the fixing unit 115 to the fixing unit 116. The conveyance unit 123 is a conveyance path for conveying a sheet from the fixing unit 115 to the sheet discharging unit 107 or the switchback unit 109 without passing through the fixing unit 116. The conveyance units 108 and 119 are conveyance paths for supplying a sheet to the printing apparatus 100.

<Control Configuration of Printing Apparatus 100>

Figure 2:
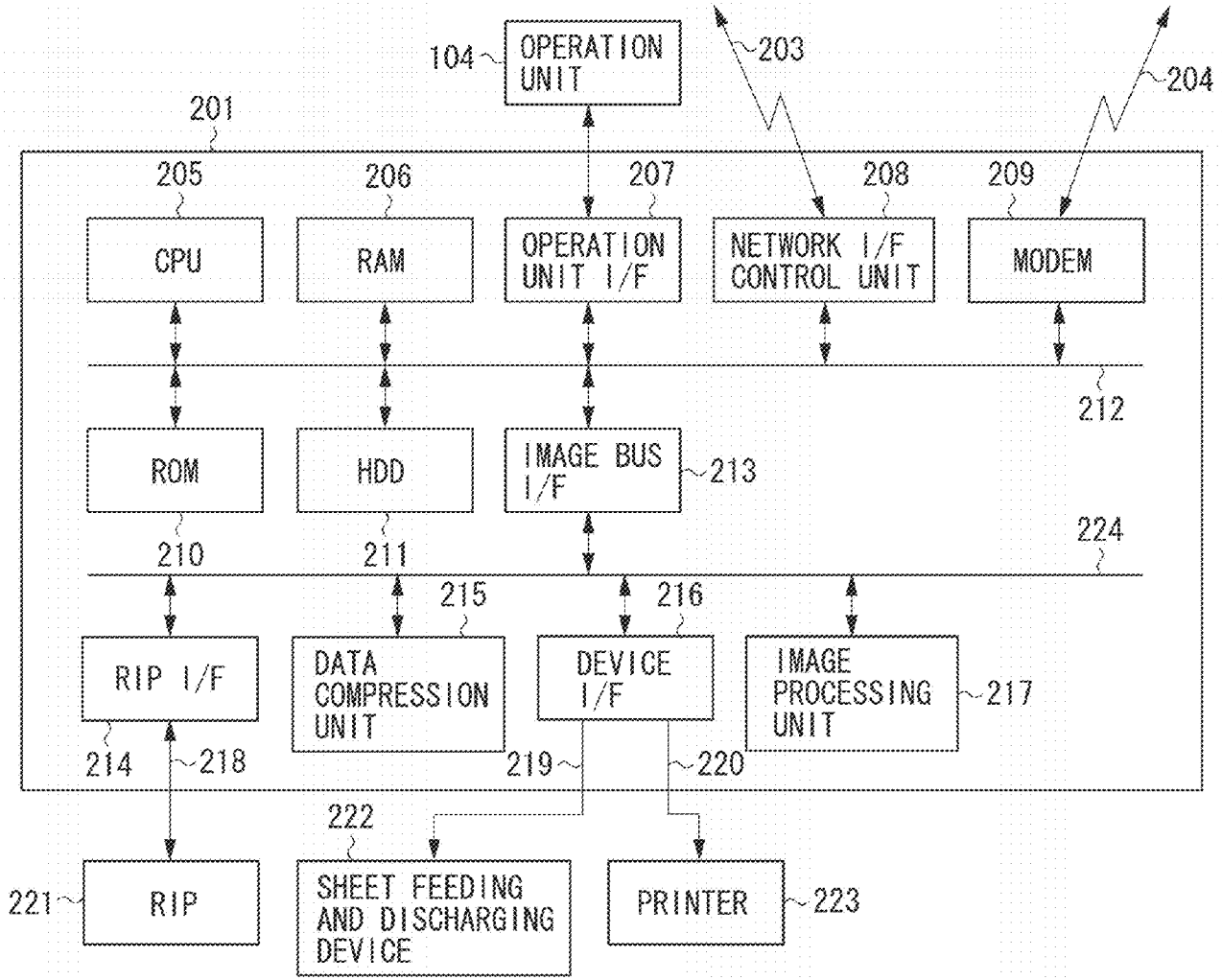
FIG. 2 is a block diagram illustrating a main controller of the printing apparatus according to an exemplary embodiment of the present invention.

Next, a control configuration of the printing apparatus 100 will be described with reference to FIG. 2. FIG. 2 is a block diagram illustrating a main controller 201 of the printing apparatus 100 according to the present exemplary embodiment.

In FIG. 2, the main controller 201 includes a central processing unit (CPU) 205, a random access memory (RAM) 206, an operation unit interface (I/F) 207, a network I/F control unit 208, a modem 209, a read-only memory (ROM) 210, and a hard disk drive (HDD) 211. The main controller 201 further includes an image bus I/F 213, a raster image processor (RIP) I/F 214, a data compression unit 215, a device I/F 216, and an image processing unit 217. The main controller 201 further includes a CPU bus 212 and an image bus 224. The CPU 205 detects the instruction states of instruction units for opening/closing the respective sheet storage cassettes for sheet replenishment, based on sensor outputs (not illustrated).

A network cable 203 for establishing network connection with an external device is connected to the network I/F control unit 208. A line cable 204 for establishing connection with an external device through a telephone line is connected to the modem 209. The CPU 205 runs a program for controlling the entire main controller 201. The RAM 206 is managed by the program running on the CPU 205.

The RAM 206 is used as a reception buffer for temporarily storing data received from outside and as an image data buffer for temporarily storing image data rasterized by a RIP 221. The RAM 206 is also used for the purpose of storing information about group settings. The ROM 210 contains programs to be run on the CPU 205 and data. The HDD 211 is a nonvolatile storage device that can store various types of data for a long term.

The operation unit I/F 207 is an interface for connecting the operation unit 104 with the main controller 201. The image bus I/F 213 is an interface for connecting the CPU bus 212 with the image bus 224. The RIP 221 is connected to the RIP I/F 214 through a data bus 218.

The RIP 221 is a rasterization board (RIP) that has the function of converting image description data input from outside into bitmap image data. The RIF I/F 214 is an interface for connecting the RIP 221 to the image bus 224 through the data bus 218. The data compression unit 215 compresses data.

A sheet feeding and discharging device 222 is connected to the device I/F 216 through a data bus 219. A printer 223 is connected to the device I/F 216 through a data bus 220. The printer 223 is configured as described with reference to FIG. 1.

The CPU 205 issues commands for performing printing to the printer 223 and the sheet feeding and discharging device 222 through the data buses 219 and 220 according to an instruction signal given from the operation unit 104 or from an external device through the network cable 203.

The image processing unit 217 applies various types of image processing to bitmap image data generated by the RIP 221. The image processing unit 217 has functions of digitally processing bitmap image data such as a function of synthesizing two pages of bitmap image data into a single page of bitmap image data.

<Grouping of Sheet Storage Units>

The grouping of sheet storage units refers to virtually handling a plurality of sheet storage units as a group. When a sheet storage unit is designated for a print job and the designated sheet storage unit runs out of paper, the printing apparatus 100 stops printing and displays a message on the operation unit 104 about the replenishment of the designated sheet storage unit with sheets.

On the other hand, when sheet storage units are grouped and a designated sheet storage unit runs out of paper, the printing apparatus 100 switches the sheet feeding source to another sheet storage unit that belongs to the same group if another sheet storage unit contains printable sheets.

Figure 3:
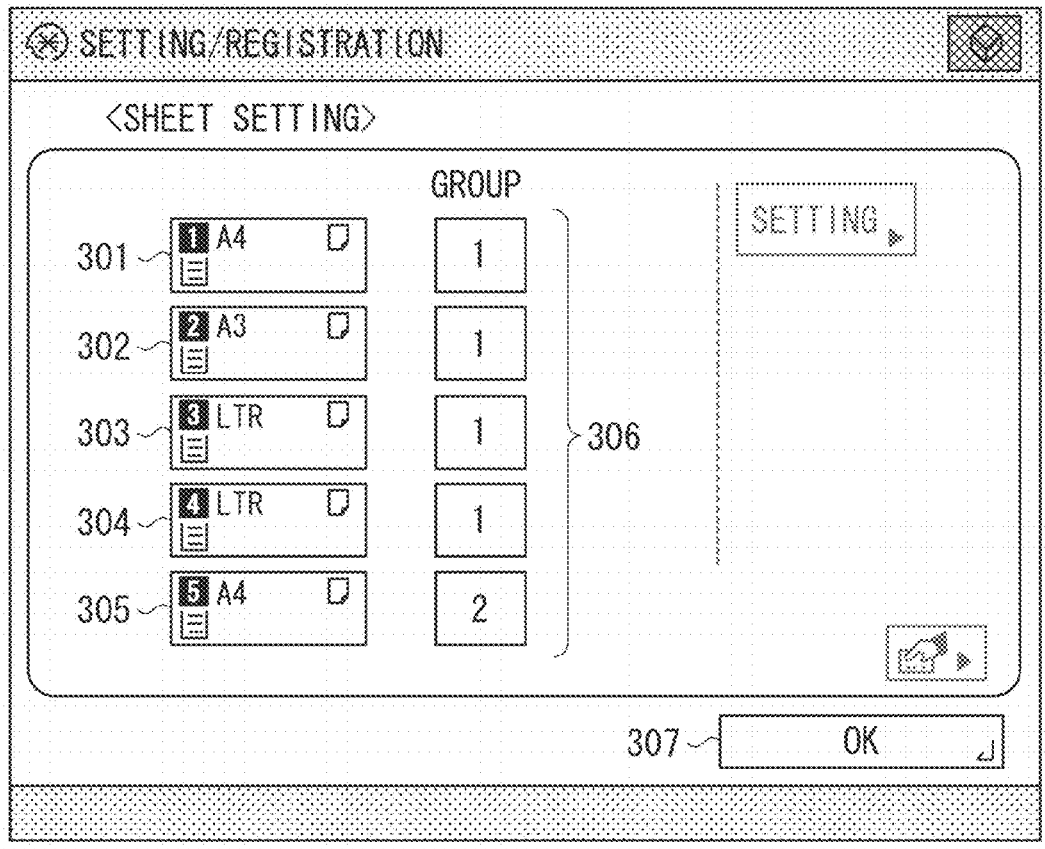
FIG. 3 is a diagram illustrating an example of a user interface (UI) screen displayed on an operation unit illustrated in FIG. 1.

FIG. 3 is a diagram illustrating an example of a user interface displayed on the operation unit 104 illustrated in FIG. 1.

This example is an example of a setting screen for grouping sheet storage units. In FIG. 3, the setting screen shows pieces of available sheet information 301, 302, 303, 304, and 305, which show sheet information (sheet size) of the sheet storage units 105, 106, 120, 121, and 122, respectively.

The setting screen includes group setting buttons 306, which indicate groups to which the sheet storage units 105, 106, 120, 121, and 122 belong. In the example of FIG. 3, the sheet storage units 105, 106, 120, and 121 belong to group 1, and the sheet storage unit 122 to group 2.

Each time the user presses a grouping setting button 306, the corresponding group number is incremented by one. The group number can be changed up to the same number as the number of sheet storage units. If the user presses a grouping setting button 306 with its group number having reached the same number of the sheet storage units, the group number returns to one.

When the user presses an OK button 307, the CPU 205 groups sheet storage units having the same numbers and stores the grouping state into the RAM 206.

Figure 4:
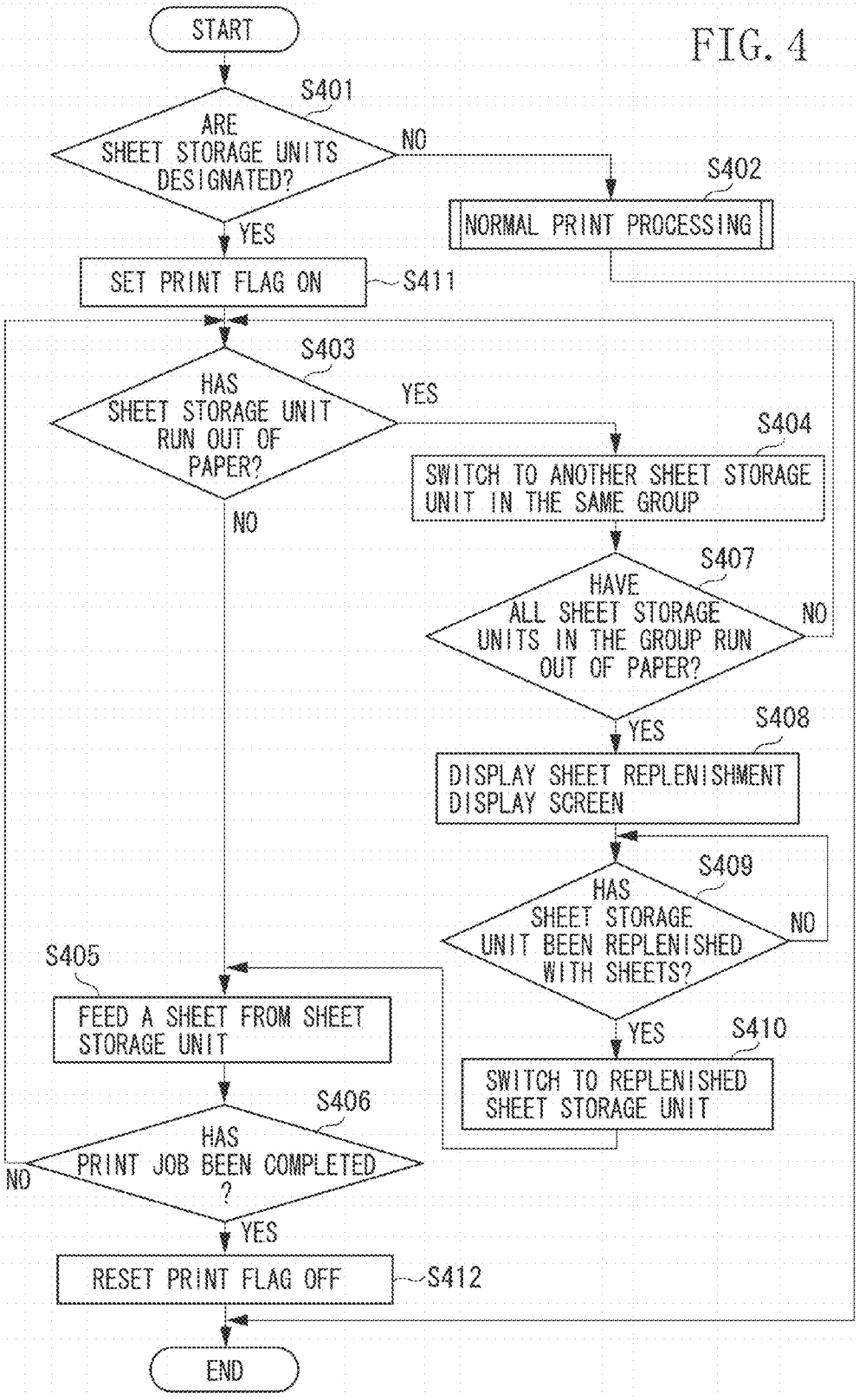
FIG. 4 is a flowchart illustrating a control method for controlling the printing apparatus.

FIG. 4 is a flowchart illustrating a control method for controlling the printing apparatus 100 according to the present exemplary embodiment. This example is an example of processing where the printing apparatus 100 performs printing by using grouped sheet storage units. The steps are implemented by the CPU 205 reading a control program from the ROM 210 or the HDD 211 and loading and executing the control program in the RAM 206.

Hereinbelow, a sheet feeding control to be performed when a print job using a plurality of grouped sheet storage cassettes is in progress. The sheet feeding control includes processing for determining whether a sheet storage cassette whose open instruction is detected by the CPU 205 is one of the grouped sheet storage portions.

The CPU 205 receives a print job from a data processing apparatus (host apparatus (not illustrated)) through the network cable 203. In step S401, the CPU 205 determines whether the print job includes designation of a sheet storage unit. In step S401, if the CPU 205 determines that no sheet storage unit is designated (NO in step S401), then in step S402, the CPU 205 performs normal print processing, and then, the present processing ends. Herein, Description of the normal print processing is omitted.

In step S401, if the CPU 205 determines that the print job includes designation of a sheet storage unit (YES in step S401), the processing proceeds to step S411. In step S411, the CPU 205 sets a print flag stored in the RAM 206 ON. The print flag indicates that the printing apparatus 100 is executing a print job with the designated sheet storage unit. The processing proceeds to step S403.

In step S403, the CPU 205 determines whether a sheet storage unit designated by the print job has run out of paper, based on the output of a paper sensor arranged on the sheet storage unit. In step S403, if the CPU 205 determines that the sheet storage unit has run out of paper (YES in step S403), the processing proceeds to step S404. In step S403, if the CPU 205 determines that the sheet storage unit designated by the print job contains sheets (NO in step S403), the processing proceeds to step S405.

In step S405, the CPU 205 controls the printing apparatus 100 to feed a sheet from the sheet storage unit designated by the print job and to perform printing. In step S406, the CPU 205 determines whether the print job has been completed.

In step S406, if the CPU 205 determines that the print job has been completed (YES in step S406), the processing proceeds to step S412. In step S412, the CPU 205 resets the print flag stored in the RAM 206, indicating that the printing apparatus 100 is executing a print job with the designated sheet storage unit, OFF. Then, the present processing ends.

In step S406, if the CPU 205 determines that the print job has not been completed (NO in step S406), the processing returns to step S403. In step S404, the CPU 205 switches the sheet storage unit to be used for the printing to another sheet storage unit that belongs to the same group as that of the sheet storage unit that has run out of paper. The processing proceeds to step S407.

In step S407, the CPU 205 determines whether all the sheet storage units belonging to the same group have run out of paper. In step S407, if the CPU 205 determines that there remain sheets to be used (NO in step S407), the processing returns to step S403.

In step S407, if the CPU 205 determines that all the sheet storage units have run out of paper (YES in step S407), the processing proceeds to step S408. In step S408, the CPU 205 gives an instruction to the operation unit 104 through the operation unit I/F 207 to display a sheet replenishment display screen. In response to the instruction, the operation unit 104 displays the sheet replenishment display screen.

The user checks the sheet replenishment display screen and replenishes a sheet storage unit with sheets to be fed for the print job. In step S409, the CPU 205 determines whether the user has replenished a sheet storage unit with sheets to be fed for the print job, based on the output of the corresponding paper sensor as described above.

In step S409, if the CPU 205 determines that the sheet storage unit has been replenished with sheets (YES in step S409) the processing proceeds to step S410. In step S409, if the CPU 205 determines that no sheet storage unit has been replenished with sheets (NO in step S409), the CPU 205 waits until the user performs sheet replenishment and the presence of replenished sheets is detected.

In step S410, the CPU 205 switches the sheet storage unit to be used to the sheet storage unit replenished in step S409. Then, the processing proceeds to step S405. In such a manner, the printing apparatus 100 groups sheet storage units, and performs printing with the grouped sheet storage units.

<First Sheet Replenishment Control>

Figure 5:
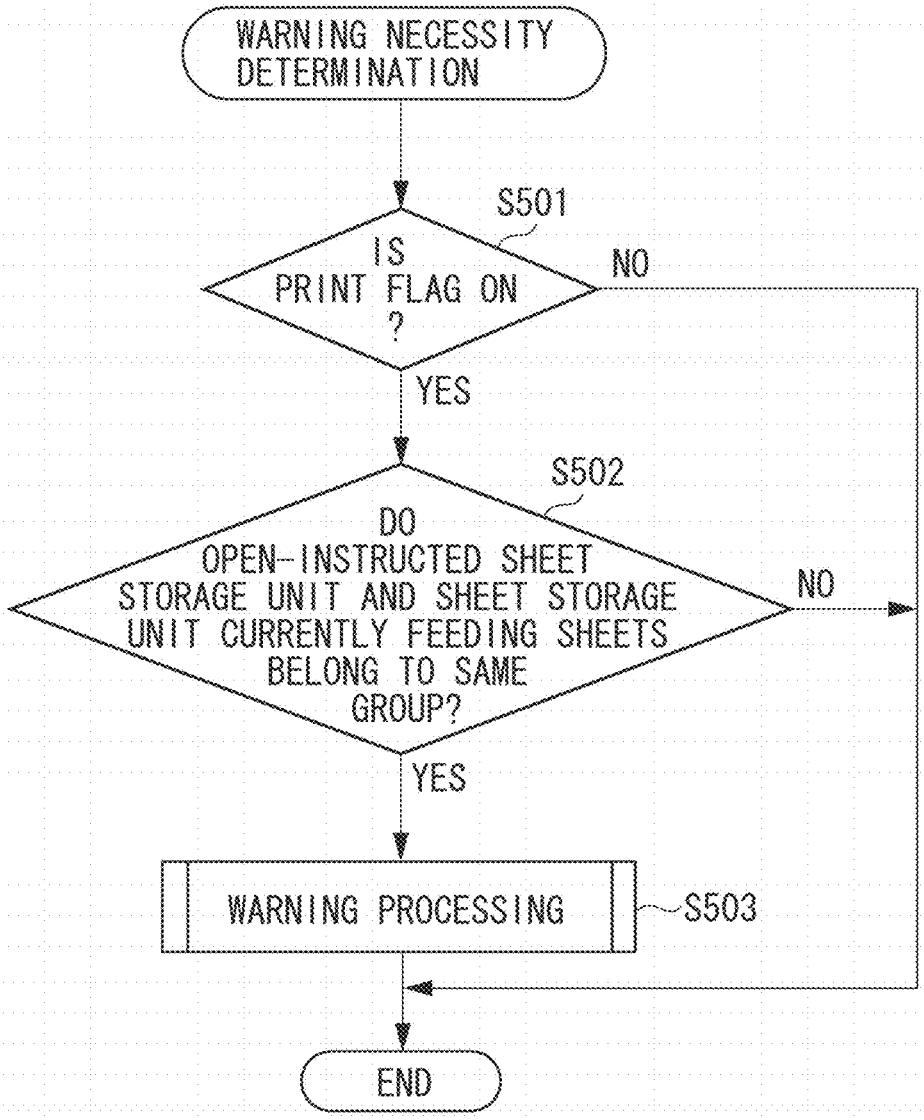
FIG. 5 is a flowchart illustrating a control method for controlling the printing apparatus.
Figure 6:
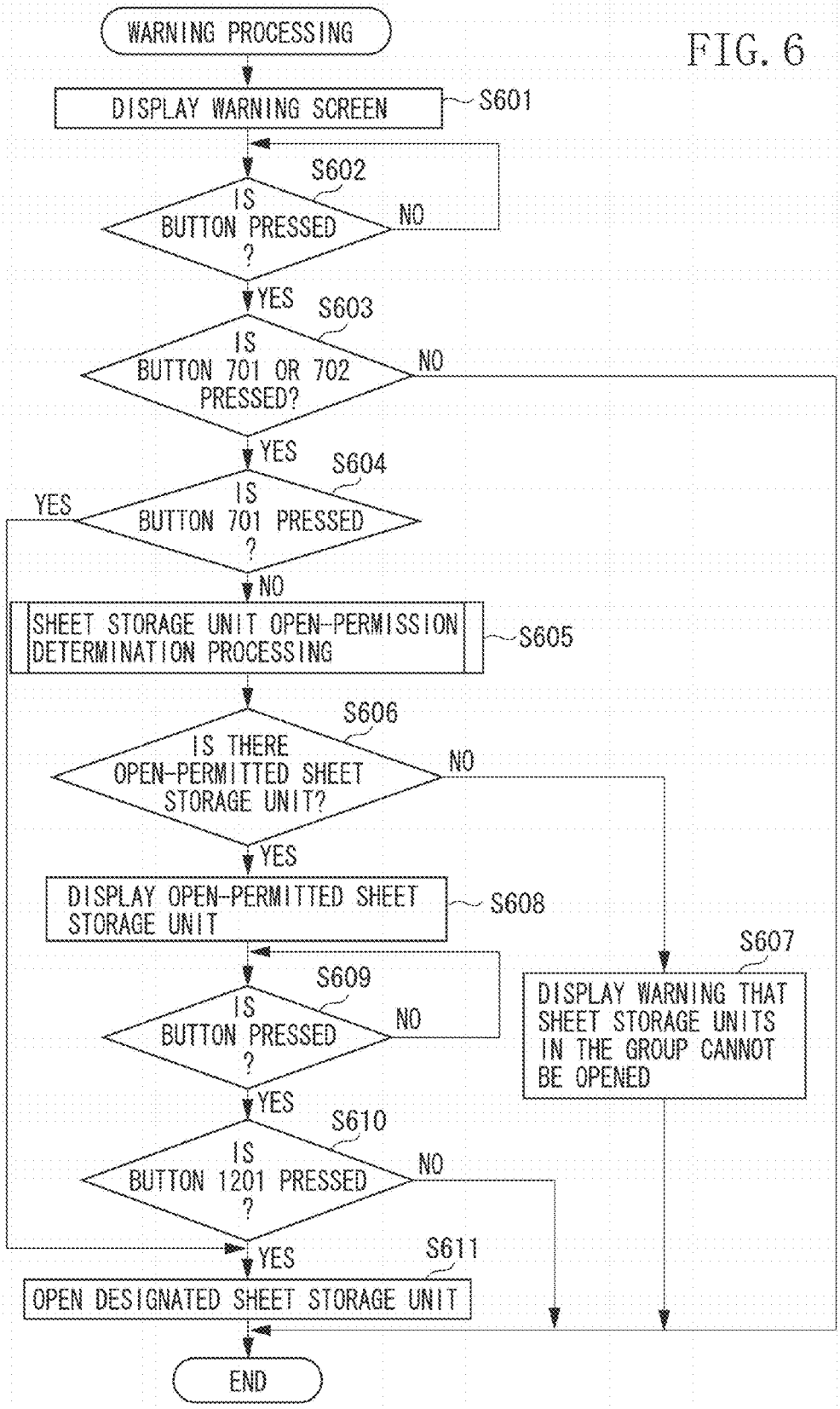
FIG. 6 is a flowchart illustrating a control method for controlling the printing apparatus.

FIGS. 5 and 6 are flowcharts illustrating a control method for controlling the printing apparatus 100 according to the present exemplary embodiment. This example is an example of processing for determining whether to display a warning when the user attempts to open a sheet storage unit. The steps illustrated in FIGS. 5 and 6 are implemented by the CPU 205 reading a control program from the ROM 210 or the HDD 211, and loading and executing the control program in the RAM 206.

FIG. 6 illustrates a detailed processing procedure of step S503 in FIG. 5. Specifically, the procedure includes displaying a warning and performing sheet storage unit open processing if needed.

Figure 7:
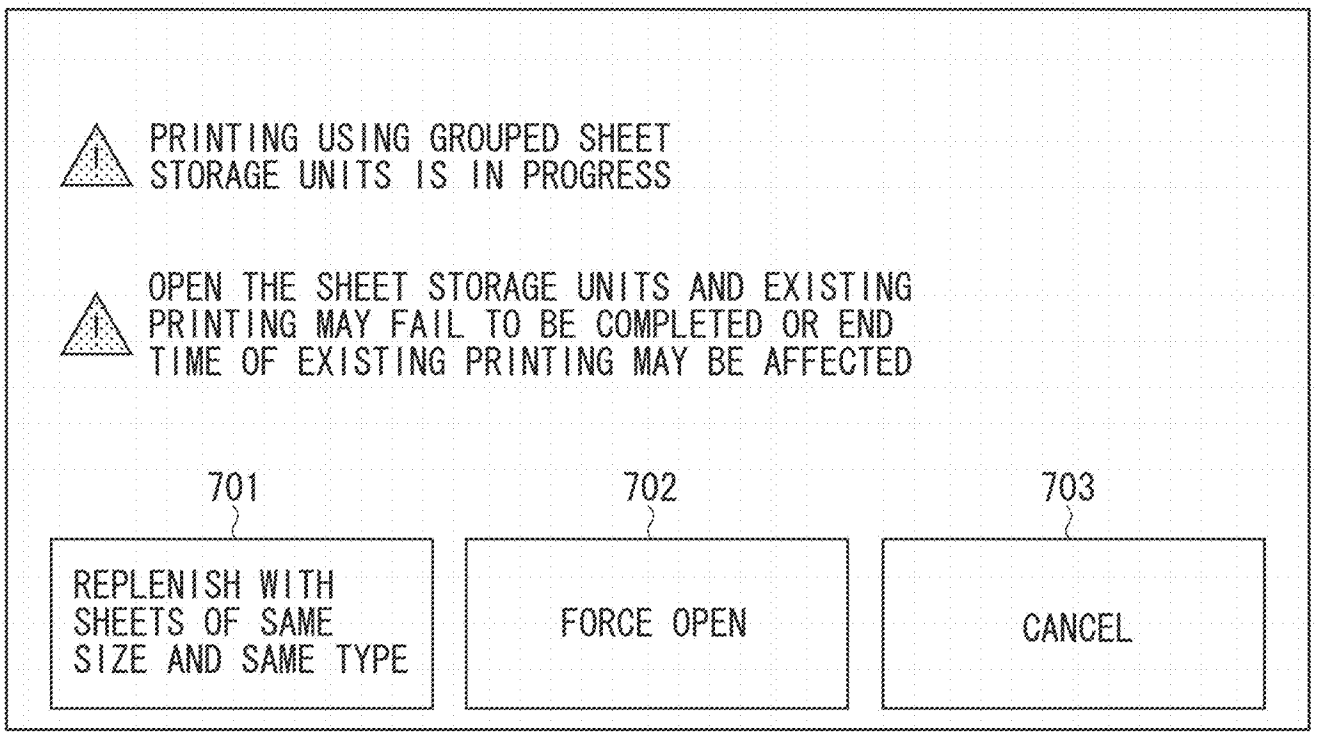
FIG. 7 is a diagram illustrating an example of a UI screen displayed on the operation unit illustrated in FIG. 1.

FIG. 7 is a diagram illustrating an example of a user interface screen displayed on the operation unit 104 illustrated in FIG. 1. This example illustrates a case where the display unit of the operation unit 104 displays a warning screen including buttons 701 to 703 for accepting three different requests.

In FIG. 7, the button 701 functions as a replenishment request button for requesting replenishment of sheets of the same type and the same size as those used to perform the print job. The button 702 functions as an open/close request button for opening and closing a sheet storage cassette whose open instruction is detected. The button 703 functions as a cancel request button for canceling the opening or closing of the sheet storage portion whose open instruction is detected.

Figure 8:
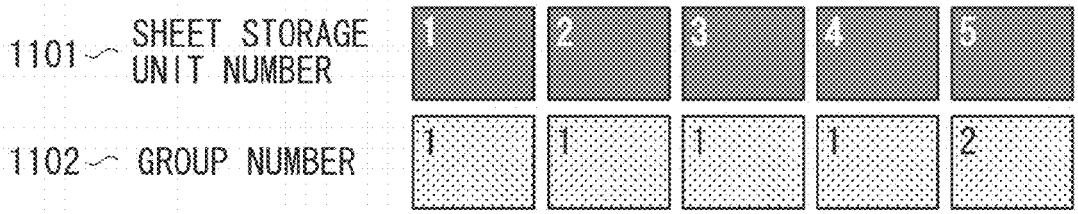
FIG. 8 is a table illustrating group attributes of sheet storage units illustrated in FIG. 1.

FIG. 8 is a table illustrating which group each of the sheet storage units illustrated in FIG. 1 belongs to.

When the user presses a sheet storage unit open button on one of the sheet storage units of the printing apparatus 100, then, in step S501 of FIG. 5, the CPU 205 accesses the RAM 206 and determines whether the print flag of the designated storage unit is ON. If the CPU 205 determines that the print flag indicating the presence of designation of sheet storage units is OFF (NO in step S501), the CPU 205 instructs the sheet feeding and discharging device 222 through the device I/F 216 to open the designated sheet storage unit. Then, the present processing ends.

On the other hand, if the CPU 205 determines that the print flag of the designated sheet storage unit is ON (YES in step S501), the processing proceeds to step S502.

In step S502, the CPU 205 reads the number of the sheet storage unit that is currently feeding sheets, from the sheet feeding and discharging device 222. The CPU 205 refers to the table illustrated in FIG. 8 to determine whether the read sheet storage unit number and the number of the open-instructed sheet storage unit belong to the same group.

When, for example, the sheet storage unit number read from the sheet feeding and discharging device 222 is "1" and the number of the open-instructed sheet storage unit is "5", since the read sheet storage unit 1 and the sheet storage unit 5 belong to different groups, the CPU 205 opens the open-instructed sheet storage unit, and then, the processing ends.

When the sheet storage unit number read from the sheet feeding and discharging device 222 is "1" and the number of the open-instructed sheet storage unit is "2", since the read sheet storage unit 1 and the sheet storage unit 2 both have group number "1", the CPU 205 determines that the sheet storage units 1 and 2 belong to the same group (YES in step S502), and the processing proceeds to step S503.

Next, step S503 will be described in detail with reference to the flowchart of FIG. 6. In step S601, the CPU 205 causes the operation unit 104 to display the warning screen illustrated in FIG. 7 through the operation unit I/F 207.

The warning screen is a screen that provides a warning that printing with grouped sheet storage units is in progress, and the printing will fail to be completed or printing performance may be affected if the grouped sheet storage units are opened.

After the display of the warning screen, the processing proceeds to step S602. In step S602, the CPU 205 waits until the user presses a button. If the user presses a button (YES in step S602), the CPU 205 writes the number of the pressed button into the RAM 206. Then, the processing proceeds to step S603.

In step S603, the CPU 205 accesses the RAM 206 and determines the number of the button pressed by the user. If the CPU 205 determines that the button pressed by the user is the button 703 for giving a cancel instruction illustrated in FIG. 7 (NO in step S603), the processing ends.

In such a manner, if the user attempts to open one of the grouped sheet storage units while printing using the grouped sheet storage units is in progress, the printing apparatus 100 warns the user that the performance of the existing printing may be affected.

This can prevent the warned user from unknowingly opening a sheet storage unit in the group to which the sheet storage unit being used belongs, and the printing in progress stopping due to paper-out. The processing subsequent to step S603 will be described in the following second sheet replenishment control.

<Second Sheet Replenishment Control>

Figure 9:
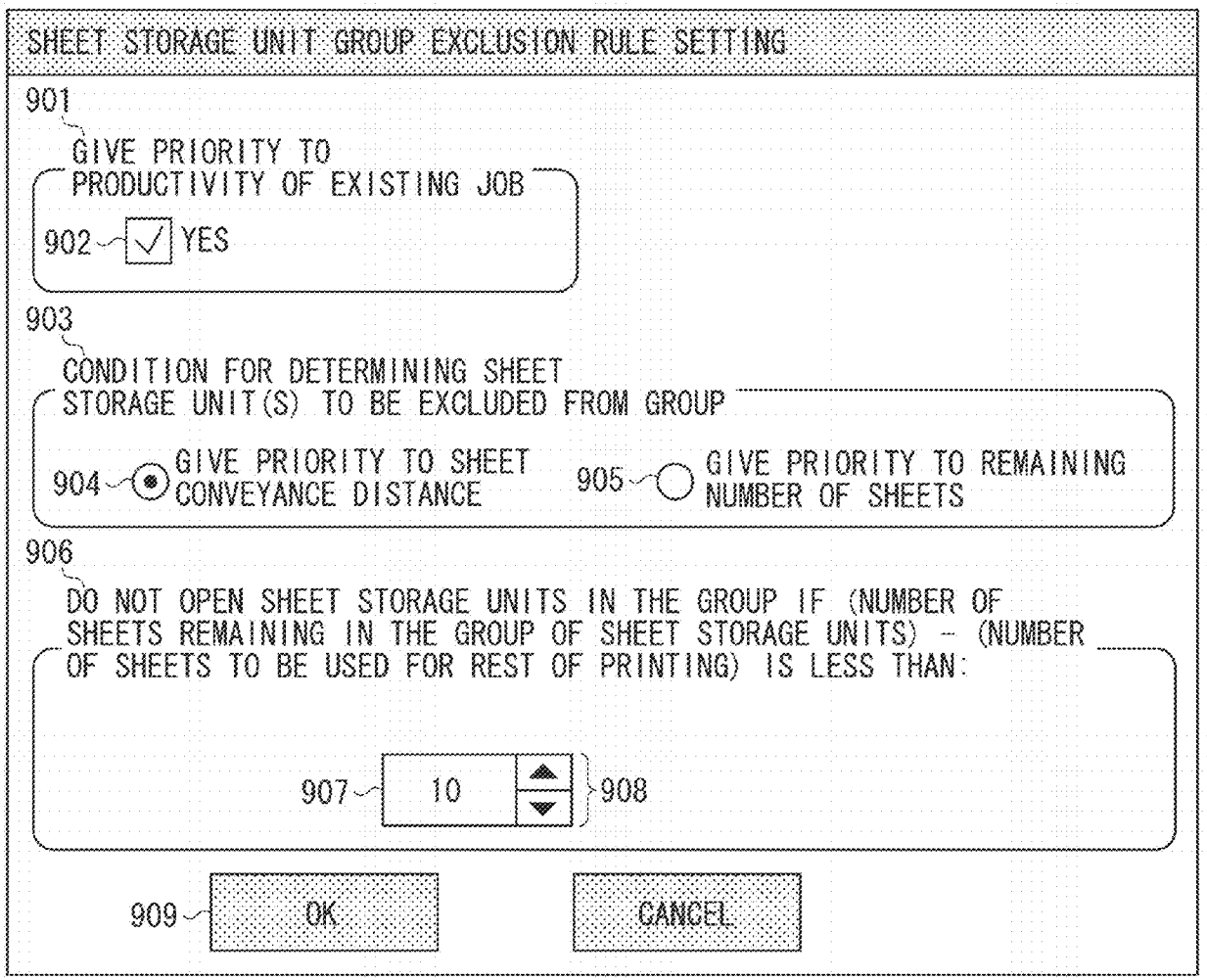
FIG. 9 is a diagram illustrating an example of a UI screen displayed on the operation unit illustrated in FIG. 1.

FIG. 9 will be described first. FIG. 9 is a diagram illustrating an example of a user interface screen displayed on the operation unit 104 illustrated in FIG. 1. This example is an example of a screen for setting a condition for determining a sheet storage unit to be excluded from a group in advance before starting a job (sheet storage unit group exclusion rule setting screen).

In FIG. 9, the sheet storage unit group exclusion rule setting screen includes an item 901 for specifying whether to give a high priority to the productivity of an existing job. If the user checks a check box 902 and presses an OK button 909, the CPU 205 writes the RAM 206 so that the printing apparatus 100 operates in the mode of giving a high priority to the productivity of the existing job.

An item 903 is an item to determine which sheet storage unit to be excluded from a group first if there is a plurality of sheet storage units that can be excluded from the group and opened. The item 903 includes radio buttons 904 and 905. If the user selects the radio button 904 for giving a higher priority to a sheet conveyance distance and presses the OK button 909, the CPU 205 performs control so that a sheet storage unit lying at the longest conveyance distance is selected as the sheet storage unit to be opened if there is a plurality of sheet storage units to be excluded from the group.

If the user selects the radio button 905 for giving a higher priority to the remaining number of sheets and presses the OK button 909, the CPU 205 performs control so that a sheet storage unit with the smallest number of remaining sheets is selected as the sheet storage unit to be opened if there is a plurality of sheet storage units to be excluded from the group.

A setting item 906 is an item to determine not to open the storage unit when the number of the sheets in the storage unit becomes less than a predetermined number. The number of sheets is calculated by subtracting the number of sheets to be used for the rest of the printing of the print job from the sum of the numbers of sheets remaining in the respective sheet storage units in the group. The number set in a spin box 907 is counted up or down by spin buttons 908. Such settings are made before the start of a job.

Figure 12:
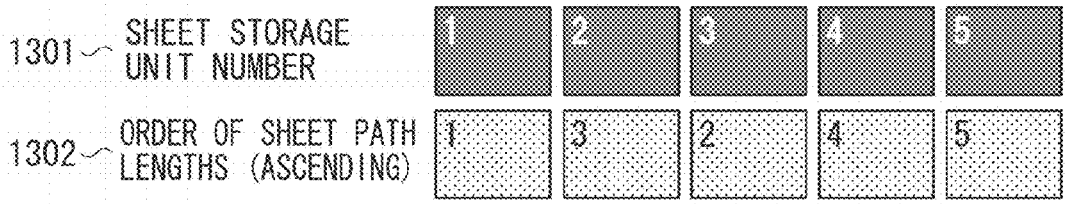
FIG. 12 is a table illustrating an order of sheet path lengths of the sheet storage units.

FIG. 12 illustrates an example of a table that prioritizes the sheet conveyance distances of the respective sheet storage units.

Returning to the description of the first sheet replenishment control (the processing of step S603 and subsequent steps illustrated in FIG. 6), in step S603, the CPU 205 accesses the RAM 206 and determines the number of the button pressed by the user. If the CPU 205 determines that the button pressed by the user is the button 701 or 702 displayed on the UI screen illustrated in FIG. 7 (YES in step S603), the processing proceeds to step S604.

In step S604, the CPU 205 determines whether the button pressed by the user is the button 701 for replenishing a sheet storage unit with sheets of the same size and the same type or the button 702 for forcing an open.

If the CPU 205 determines that the button pressed by the user is the button 701 (YES in step S604), the processing proceeds to step S611. In step S611, the CPU 205 instructs the sheet feeding and discharging device 222 through the device I/F 216 to open the sheet storage unit designated by the user, and the processing ends.

In step S604, if the CPU 205 determines that the button pressed by the user is the button 702 displayed on the UI screen illustrated in FIG. 7 (NO in step S604), the processing proceeds to step S605. The processing of step S605 will be described in detail with reference to the flowchart of FIG. 13.

Figure 13:
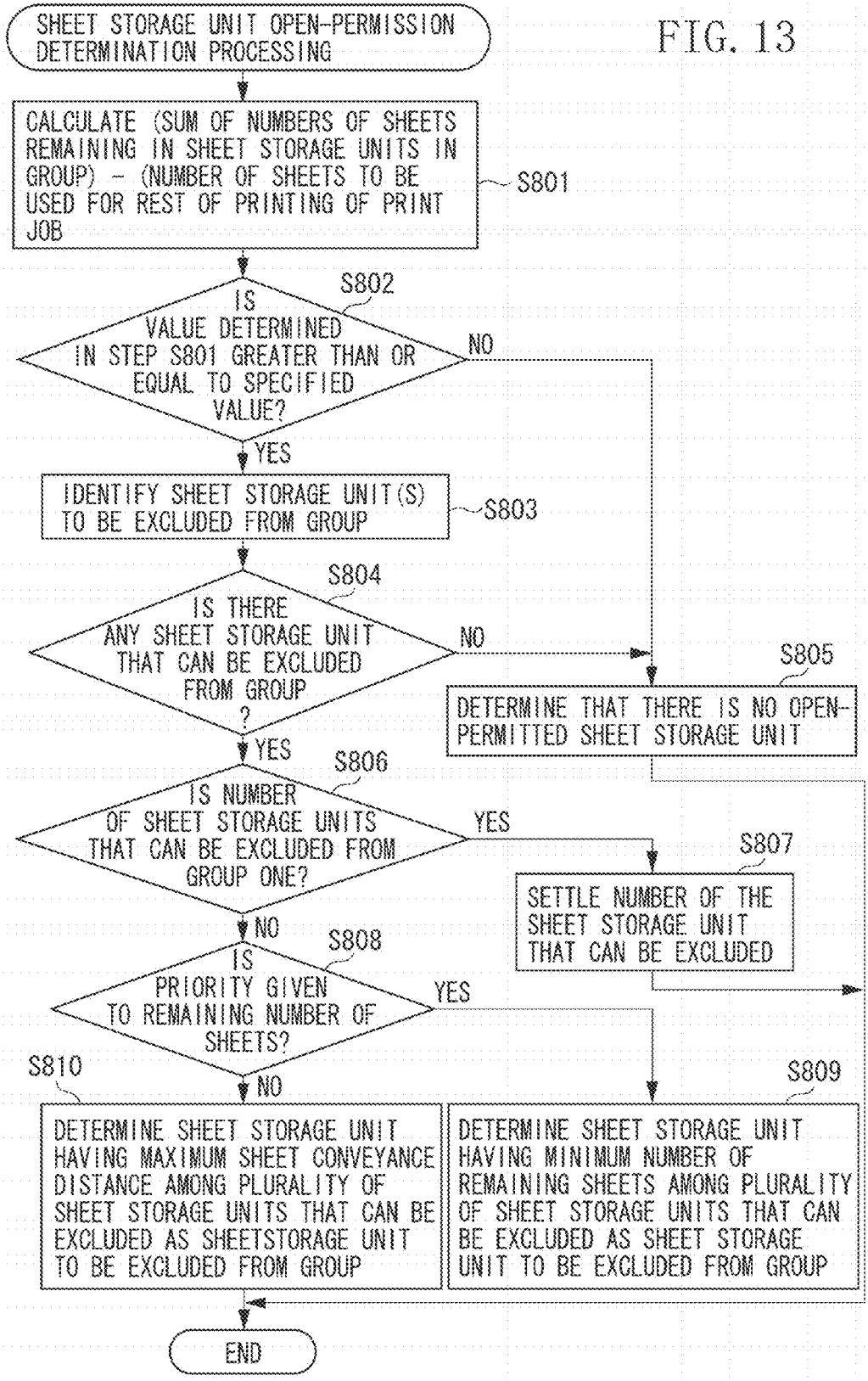
FIG. 13 is a flowchart illustrating a control method for controlling the printing apparatus.

FIG. 13 is a flowchart illustrating a control method for controlling the printing apparatus 100 according to the present exemplary embodiment. This example is an example of the detailed processing of the sheet storage unit openpermission determination processing of step S605 in FIG. 6. FIG. 9 is a diagram illustrating an example of a user interface screen displayed on the operation unit 104 illustrated in FIG. 1. This example is an example of the screen for setting a condition for determining a sheet storage unit to be excluded from a group (sheet storage unit group exclusion rule setting screen).

The steps are implemented by the CPU 205 reading a control program from the ROM 210 or the HDD 211, and loading and executing the control program in the RAM 206.

Hereinafter, processing will be described by which the CPU 205 settles a sheet storage unit or units that can be temporarily excluded from a group used in performing a print job, according to a previously-set opening/closing condition. The present exemplary embodiment is an example of switching the opening/closing condition between when a higher priority is given to the remaining number of sheets and when a higher priority is given to the sheet conveyance distance.

In step 801, the CPU 205 acquires the number of sheets to be used for the print job currently in progress to complete the printing from the RAM 206. The CPU 205 further refers to the table illustrated in FIG. 8 to check the group to which the sheet storage unit in use belongs. The CPU 205 acquires the numbers of sheets remaining in the respective sheet storage units in the group to which the sheet storage unit in use belongs from the RAM 206, and calculates the sum of the numbers of sheets.

The CPU 205 subtracts the number of sheets to be used for the print job in progress to complete the printing from the sum calculated in step S801, and writes the result value into the RAM 206. Then, the processing proceeds to step S802.

In step S802, the CPU 205 reads the value determined in step S801 from the RAM 206 and determines whether the value is greater than or equal to the value specified in the setting item 906 illustrated in FIG. 9. If the CPU 205 determines that the value determined by subtracting the number of sheets to be used for the print job in progress to complete the printing from the calculated sum is less than the value specified by the setting item 906 (NO in step S802), the processing proceeds to step S805.

In step S805, the CPU 205 writes the information into the RAM 206 that there is no sheet storage unit that is permitted to be opened, and the present processing ends. Then, the processing proceeds to step S606 illustrated in FIG. 6. In step S606, the CPU 205 accesses the RAM 206 and determines whether there is an open-permitted sheet storage unit. If the CPU 205 determines that there is no open-permitted sheet storage unit (NO in step S606), the processing proceeds to step S607.

Figure 10:
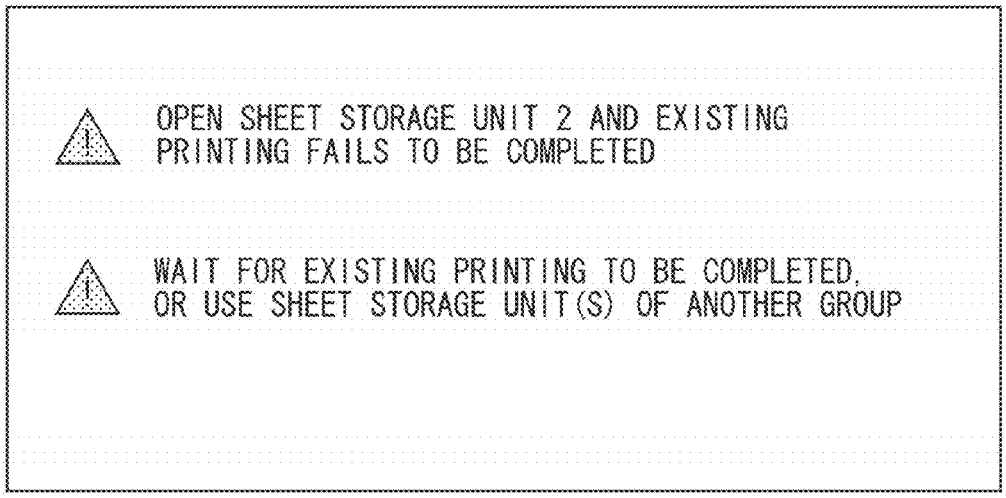
FIG. 10 is a diagram illustrating an example of a UI screen displayed on the operation unit illustrated in FIG. 1.

In step S607, the CPU 205 displays a UI screen illustrated in FIG. 10 on the operation unit 104. For example, When the user is attempting to open a sheet storage unit 2 (the sheet storage unit 302 displayed on the UI screen illustrated in FIG. 3), the CPU 205 displays a message that if the sheet storage unit 2 is opened, the existing printing fails to be completed. The CPU 205 further displays a message that the user should either wait for the completion of the existing print job or use a sheet storage unit(s) of another group. Then, the processing ends.

In step S802, if the CPU 205 determines that the result value of step S801 read from the RAM 206 is greater than or equal to the value ("10") specified by the setting item 906 on the UI screen illustrated in FIG. 9 (YES in step S802), the processing proceeds to step S803. In step 803, the CPU 205 acquires the number of sheets to be used for the print job in progress to complete the printing from the RAM 206.

The CPU 205 further refers to the table illustrated in FIG. 8 to check the group to which the sheet storage unit in use belongs. The CPU 205 acquires the numbers of sheets remaining in the respective sheet storage units in the group to which the sheet storage unit in use belongs from the RAM 206. A method for calculating a sheet storage unit to be excluded from the group will be described using an example.

Suppose the sheet storage units 105, 106, 120, and 121 are set to belong to group 1, and the numbers of sheets remaining in the sheet storage units 105, 106, 120, and 121 are 50, 40, 20, and 30, respectively. Suppose also that the number of sheets to be used for the existing print job in progress for the rest of printing is "80", and the sheet storage unit 105 is currently feeding sheets.

In this case, the CPU 205 accesses the RAM 206 to check whether the setting for giving a higher priority to the productivity of the existing job is made. If the CPU 205 determines that the setting for giving a higher priority to the productivity of the existing job is made, the CPU 205 refers to the order of sheet path lengths 1302 illustrated in FIG. 12, and adds up the numbers of sheets remaining in the sheet storage units 105, 106, 120, and 121 in ascending order of the sheet conveyance distances of the sheet storage units 105, 106, 120, and 121.

The CPU 205 identifies the sheet storage units until the sum of the remaining numbers of sheets reaches or exceeds the number of sheets to be used for the rest of the printing of the print job in progress. In the case of this example, the number of sheets remaining in the sheet storage unit 105 (sheet storage unit number 1) currently feeding sheets is 50. In ascending order of the sheet conveyance distances, the CPU 205 identifies the sheet storage unit 120 (sheet storage unit number 3) and the sheet storage unit 106 (sheet storage unit number 2) as the sheet storage units for the print job in progress to be used for the rest of the printing.

Here, the CPU 205 excludes the sheet storage units 120 and 106, as well as the sheet storage unit 105 currently feeding sheets, from sheet storage units to be opened. Subsequently, the CPU 205 determines whether the group includes any sheet storage unit that has not been excluded.

In this example, only the sheet storage unit 121 is not excluded from sheet storage units to be opened. The CPU 205 sets the sheet storage unit 121 into the RAM 206 as a sheet storage unit that can be excluded from the group. Then, the processing proceeds to step S804. In step S804, the CPU 205 accesses the RAM 206 and determines whether there is a sheet storage unit that can be excluded from the group. If the CPU 205 determines that there is no sheet storage unit that can be excluded from the group (NO in step S804), the processing proceeds to step S805.

Since the processing of step S805 and subsequent steps have already been described, description thereof will be omitted. If there is a sheet storage unit that can be excluded from the group (YES in step S804), the processing proceeds to step S806. In step S806, the CPU 205 accesses the RAM 206 and determines whether the number of sheet storage units that can be excluded from the group is one. Like this example, if the number of sheet storage units that can be excluded from the group is one (YES in step S806), the processing proceeds to step S807.

In step S807, the CPU 205 determines the numbers of the sheet storage units that can be excluded from the group, and writes the numbers into the RAM 206. Then, the processing ends.

In step S606, if the CPU 205 accesses the RAM 206 and determines that there is a sheet storage unit that can be excluded from the group (YES in step S606), then in step S608, the CPU 205 displays a UI screen on the display unit of the operation unit 104 through the operation unit I/F 207. Then, the processing proceeds to step S609 illustrated in FIG. 6.

Figure 11:
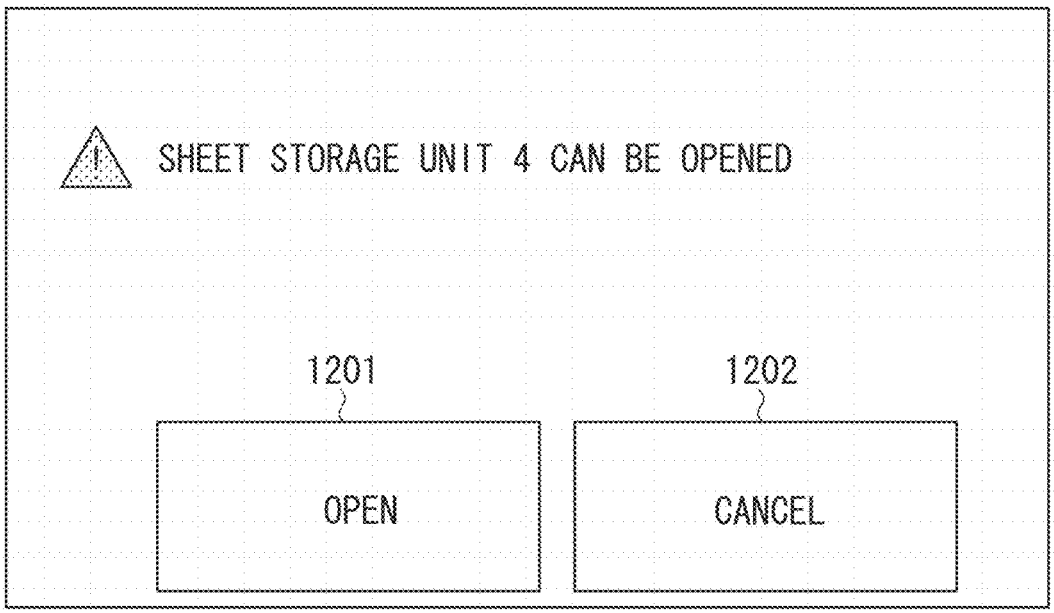
FIG. 11 is a diagram illustrating an example of a UI screen displayed on the operation unit illustrated in FIG. 1.

Specifically, the CPU 205 displays a UI screen for prompting the user to determine whether to open the open-permitted sheet storage unit as illustrated in FIG. 11.

In step S609 illustrated in FIG. 6, the CPU 205 waits until the user presses a button. If the user presses a button (YES in step S609), the CPU 205 writes the number of the pressed button into the RAM 206, and the processing proceeds to step S610. In step S610, the CPU 205 accesses the RAM 206 and checks the number of the button pressed by the user. If the CPU 205 determines that the button pressed by the user is the button 1202 (NO in step S610), the processing ends.

If the CPU 205 determines that the button pressed by the user is the button 1201 (YES in step S610), then in step S611, the CPU 205 instructs the sheet feeding and discharging device 222 to open the corresponding sheet storage unit through the device I/F 216, and the processing ends. In this example, the sheet storage unit 121 is opened.

In step S803, if the setting for giving a high priority to the productivity of the existing job is not made, the CPU 205 identifies the sheet storage units in descending order of the numbers of sheets remaining in the sheet storage units in the group until the sum of the remaining numbers of sheets reaches or exceeds the number of sheets to be used for the rest of the printing for the print job in progress.

In this example, the number of sheets remaining in the sheet storage unit 105 currently feeding sheets is 50. Therefore, 30 sheets are needed to complete the printing of the print job. The sheet storage unit that has the maximum number of remaining sheets among the sheet storage units included in the group, except the sheet storage unit 105 currently feeding sheets, is the sheet storage unit 106 (with the remaining number of sheets "40"). The CPU 205 then excludes the sheet storage unit 106 from the sheet storage units to be opened.

Subsequently, the CPU 205 checks whether the group includes any sheet storage unit that has not been excluded. In this example, the sheet storage units 120 and 121 have not been excluded from sheet storage units to be opened.

The CPU 205 sets the sheet storage units 120 and 121 into the RAM 206 as sheet storage units that can be excluded from the group. Then, the processing proceeds to step S804. In step S804, the CPU 205 accesses the RAM 206 and checks whether there is a sheet storage unit that can be excluded from the group.

In this example, since there is a sheet storage unit that can be excluded from the group (YES in step S804), the processing proceeds to step S806. In step S806, the CPU 205 accesses the RAM 206 and checks whether the number of sheet storage units that can be excluded from the group is one.

In this example, since the number of sheet storage units that can be excluded from the group is not one (NO in step S806), the processing thus proceeds to step S808. In step S808, the CPU 205 accesses the RAM 206 and reads the numbers of the sheet storage units that can be excluded from the group, and the conditions for determining a sheet storage unit to be excluded from the group, set by the item 903 of FIG. 9.

If the value set by the item 903 indicates that a higher priority is given to the sheet conveyance distance 904, (NO in step S808), the processing proceeds to step S810. In step S810, the CPU 205 accesses the RAM 206 and sets a sheet storage unit lying at the maximum sheet conveyance distance among the sheet storage units to be excluded from the group as the sheet storage unit to be excluded from the group. Then, the processing ends. In this example, the CPU 205 sets the sheet storage unit 121 as the sheet storage unit to be excluded from the group.

In step S808, if the CPU 205 determines that the value set by the item 903 indicates that a higher priority is given to the remaining number of sheets 905, (YES in step S808), the processing proceeds to step S809. In step S809, the CPU 205 accesses the RAM 206 and sets a sheet storage unit having the minimum number of remaining sheets among the sheet storage units to be excluded from the group as the sheet storage unit to be excluded from the group. Then, the processing ends.

In this example, the CPU 205 sets the sheet storage unit 120 as the sheet storage unit to be excluded from the group. The processing then proceeds to step S606. The subsequent procedure is the same as that when a higher priority is given to the productivity of the existing job. Therefore, the description thereof is omitted.

As described above, sheets of the same size and the same type can be replenished even when printing using grouped sheet storage units is in progress. When the user attempts to open a sheet storage unit included in the group to which the sheet storage unit currently feeding sheets belongs, the opening of the sheet storage unit can be controlled so as to avoid effects on the existing print job.

Since there is provided the setting item about whether to give a higher priority to the productivity of an existing job, it is possible to select whether to perform a sheet storage unit opening control for maximizing the production efficiency of the existing print job or perform a sheet storage unit opening control in consideration of subsequent printing.

The above-described exemplary embodiment is made of the case where an open instruction is accepted during execution of printing. If the open-instructed sheet storage portion belongs to the same group as that of the sheet storage portion used for printing, a warning screen is displayed. The open-instructed sheet storage portion is then opened depending on a user instruction.

However, the present invention is not limited thereto. For example, if an open instruction is accepted during execution of printing and the open-instructed storage unit belongs to the same group as that of the sheet storage unit used for printing, the opening of the open-instructed sheet storage unit may be prohibited.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-193722 filed Sep. 6, 2011, which is hereby incorporated by reference herein in its entirety.

What is claimed is:

1. A printing apparatus for conveying a sheet from any one of a plurality of sheet storage units configured to store sheets and printing an image on the conveyed sheet, the printing apparatus comprising:

a registering unit configured to register two or more of the plurality of sheet storage units as a group;

a printing unit configured to continue printing by switching a sheet conveyance source to another of the two or more sheet storage units registered as the group in a case where an amount of sheets set in one of the two or more sheet storage units registered as the group by the registering unit becomes a predetermined amount or lower when printing using the sheet storage unit is in progress;

a receiving unit configured to receive an instruction to open any one of the plurality of sheet storage units; and a control unit configured to permit opening the instructed sheet storage unit by the instruction in a case where the receiving unit receives the instruction during execution of printing and the instructed sheet storage unit does not belong to the same group as that of the sheet storage unit used in the printing, and restrict opening the instructed sheet storage unit by the instruction in a case where the receiving unit receives the instruction during execution of printing and the instructed sheet storage unit belongs to the same group as that of the sheet storage unit being used in the printing.

2. The printing apparatus according to claim 1, further comprising a display unit configured to display a reason why the instructed sheet storage unit is not permitted to be opened by the instruction in a case where the receiving unit receives the instruction during execution of printing and the instructed sheet storage unit belongs to the same group as that of the sheet storage unit used in the printing.

3. The printing apparatus according to claim 2, wherein the control unit permits opening the instructed sheet storage unit by a second instruction to open the instructed sheet storage unit in a case where the second instruction is received from a user after the displaying of the display unit.

4. The printing apparatus according to claim 2, wherein the control unit restricts opening the instructed sheet storage unit by the instruction in a case where the receiving unit receives the instruction during execution of printing, the instructed sheet storage unit belongs to the same group as that of the sheet storage unit being used in the printing, and a difference between a sum of the numbers of sheets set in the respective two or more sheet storage units included in the group to which the sheet storage unit used in the printing belongs and the number of sheets to be used in the printing is less than a predetermined value.

5. A printing apparatus for conveying a sheet from any one of a plurality of sheet storage units configured to store sheets, and printing an image on the conveyed sheet, the printing apparatus comprising:

a registering unit configured to register two or more of the plurality of sheet storage units as a group;

a printing unit configured to continue printing by switching a sheet conveyance source to another of the two or more sheet storage units registered as the group in a case where an amount of sheets set in one of the two or more sheet storage units registered as the group by the registering unit becomes a predetermined amount or less while printing using the sheet storage unit is in progress;

a receiving unit configured to receive an instruction to open any one of the plurality of sheet storage units; and a control unit configured to permit opening the instructed sheet storage unit by the instruction in a case where the receiving unit receives the instruction during execution of printing and the instructed sheet storage unit does not belong to the same group as that of the sheet storage unit being used in the printing, and warn a user in a case where the receiving unit receives the instruction during execution of printing and the instructed sheet storage unit belongs to the same group as that of the sheet storage unit being used in the printing.

6. A control method for controlling a printing apparatus for conveying a sheet from any one of a plurality of sheet storage units configured to store sheets, and printing an image on the conveyed sheet, the control method comprising:

registering two or more of the plurality of sheet storage units as a group;

continuing printing by switching a sheet conveyance source to another of the two or more sheet storage units registered as the group in a case where an amount of sheets set in one of the two or more sheet storage units registered as the group by the registering unit becomes a predetermined amount or less while printing using the sheet storage unit is in progress;

receiving an instruction to open any one of the plurality of sheet storage units;

permitting opening the instructed sheet storage unit by the instruction in a case where the instruction is received during execution of printing and the instructed sheet storage unit does not belong to the same group as that of the sheet storage unit used in the printing; and restricting opening the instructed sheet storage unit by the instruction in a case where the instruction is received during execution of printing and the instructed sheet storage unit belongs to the same group as that of the sheet storage unit being used in the printing.

7. A non-transitory computer-readable storage medium for storing a computer program for causing a computer to execute the control method according to claim 6.

* * * * *